United States Patent [19]

Ricci

[11] 4,297,824

[45] Nov. 3, 1981

[54] MODULAR PREFABRICATED SEMI-PANELS TO BUILD INSIDE OR BEARING WALLS BY MEANS OF AUXILIARY CONNECTING SPACERS

[76] Inventor: Giovanni B. Ricci, Via Palozzina, 1-f Viterbo, Italy

[21] Appl. No.: 51,457

[22] Filed: Jun. 22, 1979

[30] Foreign Application Priority Data

Nov. 12, 1978 [IT] Italy ..... 86007 A/78
Jan. 31, 1979 [IT] Italy ..... 47849 A/79

[51] Int. Cl.[3] ..... E04C 1/16
[52] U.S. Cl. ..... 52/568; 52/712
[58] Field of Search ..... 52/424–434, 52/562–569, 426, 712, 568

[56] References Cited

U.S. PATENT DOCUMENTS

| | | | |
|---|---|---|---|
| 1,141,445 | 6/1915 | Davison | 52/568 |
| 1,294,224 | 2/1919 | Bellingham | 52/586 |
| 1,345,156 | 6/1920 | Flynn | 52/426 |
| 1,598,197 | 8/1926 | Hill | 52/712 |

FOREIGN PATENT DOCUMENTS

| | | | |
|---|---|---|---|
| 857507 | 4/1940 | France | 52/426 |
| 928002 | 5/1947 | France | 52/564 |
| 1271208 | 7/1961 | France | 52/426 |
| 411591 | 2/1945 | Italy | 52/426 |
| 454975 | 2/1950 | Italy | 52/568 |
| 159094 | 3/1933 | Switzerland | 52/568 |

*Primary Examiner*—James L. Ridgill, Jr.
*Attorney, Agent, or Firm*—Watson, Cole, Grindle & Watson

[57] ABSTRACT

A construction member for building inner and/or bearing walls and the like includes a pair of semi-panels arranged spaced apart in opposed specular relation, the panels comprising plane bodies forming faces of a building structure, integral connecting elements protruding from the bodies having opposed outer ends spaced at a predetermined distance apart, and a connecting spacer extending between the bodies and being interconnected with the connecting elements. One of the connecting elements and the opposite ends of the spacer is substantially U-shaped with parallel inner surfaces, and the other of the connecting elements and the opposite ends being flat with parallel outer surfaces so as to facilitate an interdigitated interconnection of the spacer and the panels.

1 Claim, 9 Drawing Figures

MODULAR PREFABRICATED SEMI-PANELS TO BUILD INSIDE OR BEARING WALLS BY MEANS OF AUXILIARY CONNECTING SPACERS

The present invention relates to prefabricated modular semi-panels usable in pairs in a specular disposition thereof, the two semi-panels of each pair being connected to each other by means of suitable connecting spacers, so that single inner or bearing wall elements may be preformed and then assembled for building purposes.

The advantages which are derived from the use of these semi-panels to build inner or mid-walls as well as bearing walls and other building elements are at least partially known, and others may be deduced by those skilled in the art. The underlying principles as well as the improvements of the invention will be pointed out by describing and illustrating some embodiments thereof in order to comprehend the possible and extensible use of the invention and to render more clearly some characteristics of the new semi-panel as well as the possibility of providing many combinations by connecting the same by means of appropriate spacers.

The following description will evidence several embodiments which are particularly suitable for the construction of walls or the like. Through the description, which is referred to the accompanying drawings, those skilled in the art may actually confirm the innovating features of the invention and deduce the advantages which are derived through the many types of buildings.

Figure 8:
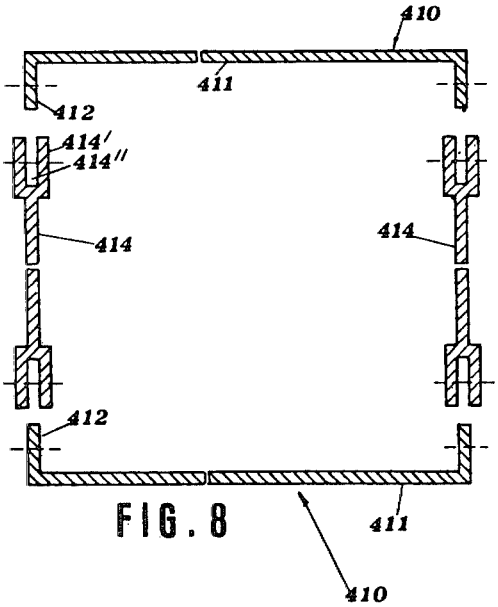
Figure 9:
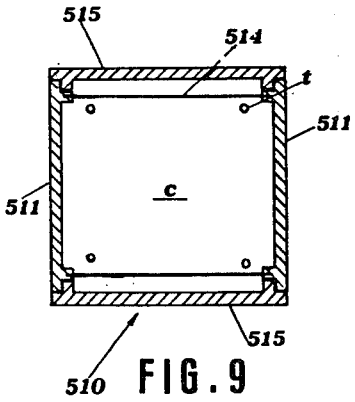

FIG. 8 is a schematic exploded horizontal section of semi-panels and respective connecting spacers according to another embodiment; and FIG. 9 is a schematic horizontal section of a pair of semi-panels specularly opposed and connected by means of spacers, the pair of semi-panels being assembled with another pair of similar elements to provide the perimetrical part of a piller form for concrete casting.

Figure 1:
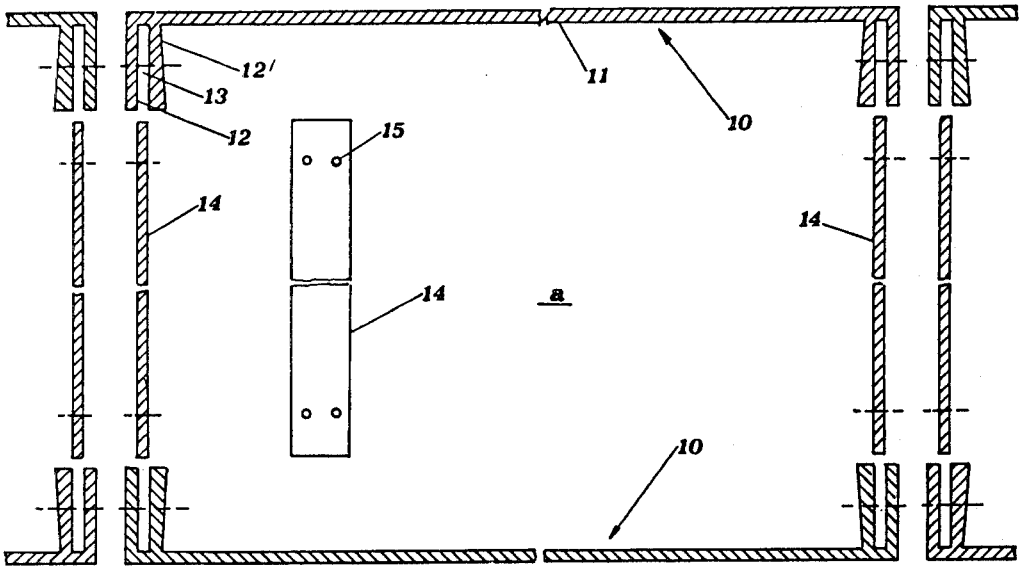
FIG. 1 is an exploded, schematic sectional view taken along a horizontal plane of semi-panels and respective connecting spacers according to a first embodiment of the present invention, the spacers being in the form of rectangular plates having a limited width and which are, in turn, spaced apart from each other.

Turning now to the drawings and, in particular to FIG. 1, there is shown in exploded view semi-panels 10 and respective spacers 14, the arrangement of which evidence the possibility of building a wall by the same.

Semi-panels 10, which are clearly of a modular type, comprise a plane body 11 forming one face of the wall, and a pair of elements 12—12' protruding perpendicularly therefrom at its opposed ends, these elements being spaced and parallel so that a free hollow space 13 may be formed therebetween.

A first set of modular prefabricated semi-panels 10, the body 11 of which will provide one face of the wall, are then arranged so that when assembled element 12 of the panels are interconnected in manner suitable for the material of the semi-panel 10.

A second set of modular semi-panels 10 will then be arranged specularly opposed to the first one mentioned above so that the second face of the wall may be preformed.

In accordance with the principles of the present invention, the wall thickness will depend on the length of connecting spacers 14 which permit the connection of the specularly opposed protruding elements 12—12', the connection between 12—12' and 14 being provided by suitable conventional means after the respective spacer 14 is inserted within the free space 13 between 12 and 12'. In the case of FIG. 1, spacer 14 has also been shown notated 90° about its central axis to shown its limited width and to confirm, in this manner, the arrangement of spacers 14 spaced apart from each other.

According to this embodiment, holes 15 may for example be provided at the ends of connecting spacer 14, and corresponding holes may be provided in protruding elements 12—12' so that bolts, rivets or the like may be used which are appropriate to fasten the connected parts 12—12' and 14.

Figure 6:
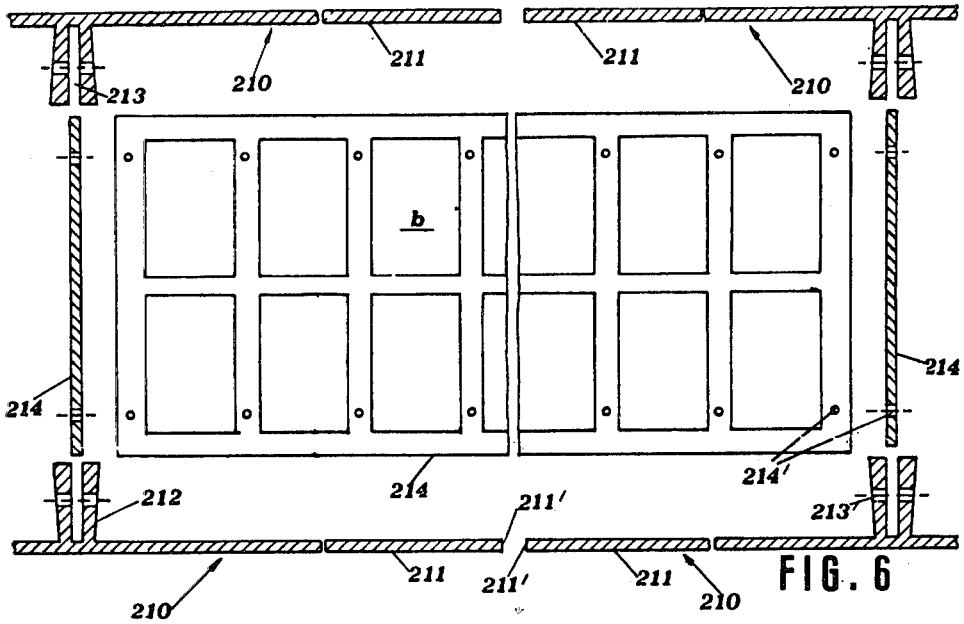
FIG. 6 is a schematic view of the embodiment of a semi-panel wall according to FIG. 1, wherein, however, the connecting spacers of each pair of the specularly opposed semi-panels extend the entire height of the wall.

It should be pointed out that, when a wall is formed by modular semi-panels 10 interconnected by spacers 14, as aforedescribed an interspace a will be provided between the semi-panels which may be filled entirely or partially as desired, for example by concrete casting, or by insulating and/or sound-deadening material. That interspace may also allow the passage of pipes, electric cables and the like. The carriage of these types of semi-panels and spacers as component elements of a building structure will then be easier and more convenient, and the assembling operations of same at the building site will also be easier. In this embodiment of the present invention the connecting spacers 14 are shown as rectangular plates having a limited width and arranged vertically in a spaced disposition. According to another embodiment which is schematically illustrated in FIG. 6, each set of connecting spacers vertically interspaced may be replaced by a single element 214, the longitudinal opposed edges of which are inserted within spaces 213 of specularly opposed protusions 212 and are fastened thereto for example in the aforementioned conventional manner, by using similar appropriate holes 213', 214'.

Each pair of semi-panels 210 which form one component of a wall is then provided with only two spacers 214 connected to respective protusions 212 of the semi-panels, the height thereof being equal to that of the wall.

In accordance with the building structure to be preformed, connecting spacers 214 may be fabricated with a suitable number of openings b to obtain economical and carriage advantages without any negative influence on strength and functionality of the building unit so obtained.

A further important and useful embodiment of modular semi-panels according to the present invention is schematically illustrated in FIGS. 2 to 5 of the accompanying drawings. In the more detailed view of FIG. 5 it can be seen that each semi-panel 110 comprises a main plane body 111 which forms a face of the wall and has protusions 112 at both ends thereof, these protusions being extended along the entire height of same and then along the entire height of the wall, this latter having then the semi-panels as modular component elements of the same. In this embodiment, protrusions 112 are of a rectangular tubular shape being spaced inner cavities 113, openings 113' being spaced along the shorter inner free side of each rectangular protrusion 112 so that pairs of connecting spacers 114 may be inserted therein to connect the specularly opposed component semi-panels 110 of the wall.

Figure 5:
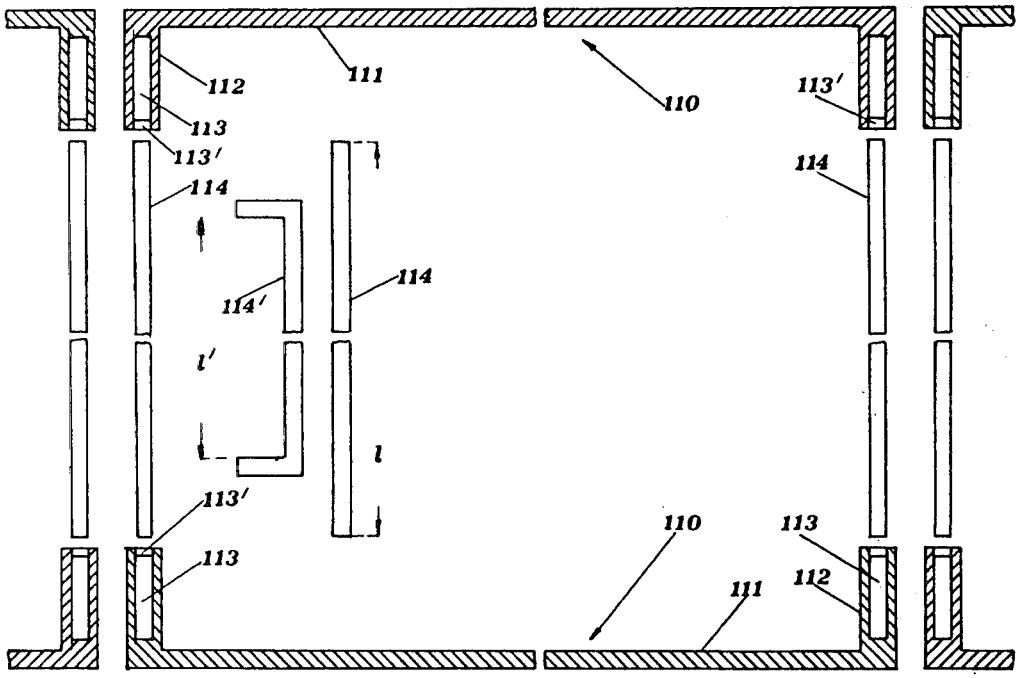
FIG. 5 is a schematic exploded cross-section view taken along a horizontal plane, which relates to semi-panels and spacers as in FIGS. 2 to 4, the component prefabricated elements being shown in detail for comparative purpose in respect to similar elements shown in FIG. 1.

Also in FIG. 5, the constructive combination of semi-panels 110 is schematically illustrated, the respective connecting spacers have been shown rotated 90°, to better illustrate the shape and arrangement of same, similarly as schematically shown in FIGS. 1 and 6. In the embodiment of FIG. 5, pairs of connecting spacers 114, 114' are provided which preferably comprise rods of square cross-section. Spacer 114 is a rectilinear rod the length l which corresponds to the desired distance between the shorter abutment sides of cavities 113 of specularly opposed protusions 112, so that the distance may be correctly defined. Spacer 114' has, on the contrary, its ends bent at 90° in order that a spacer may be provided the distance 1' of which between the opposed inner sides of these bent ends corresponds to the distance between the other shorter sides of cavities 113 of said specularly opposed protusions 112. Through practical experiments it has deduced that by using the so paired connecting spacers 114, 114', wherein the former is preferably placed on the latter as in FIG. 3, it is possible to confer to the built wall a satisfying assurance against tensive and compressive stresses which tend to move away or approach, respectively, the two component semi-panels 110 of a wall particularly when this later is to be assembled.

Figure 2:
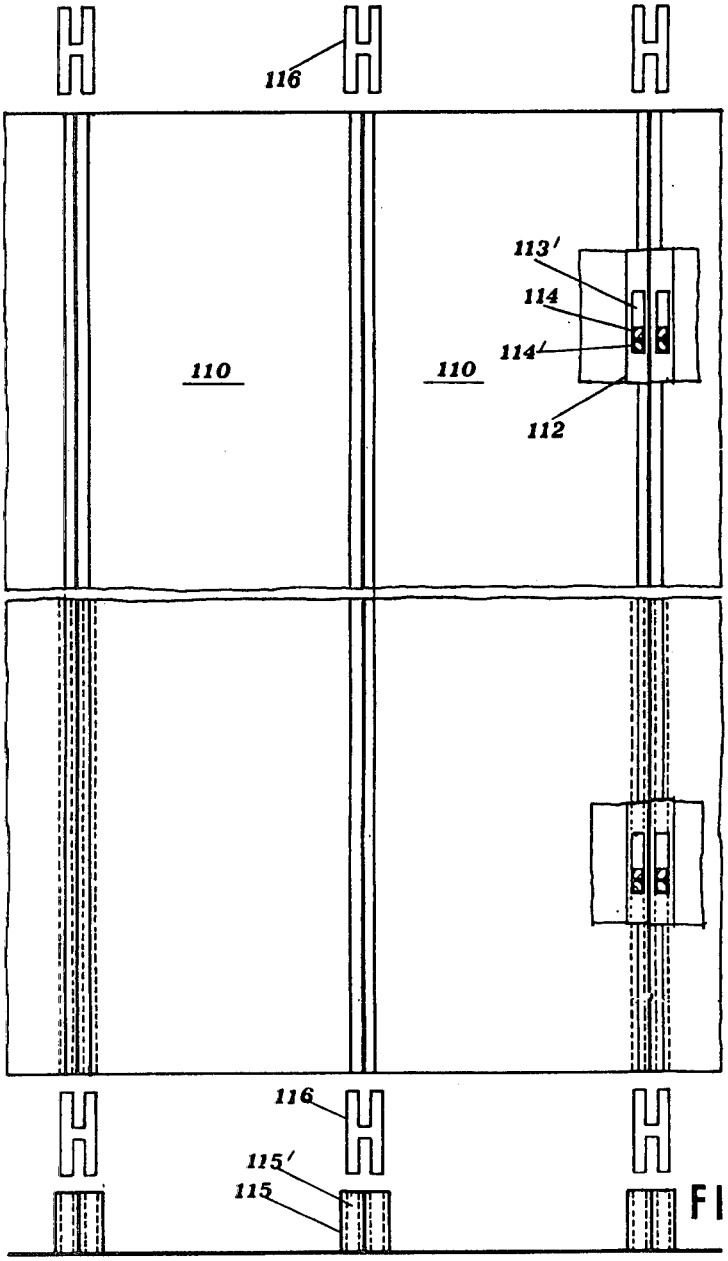
FIG. 2 is a schematic view of a part of one face of a wall made by assembling other types of semi-panels and spacers, auxiliary connecting means also being shown to connect the wall therebetween and also to the substructure and/or upper elements, typical spacers being evidenced in partial cross-sections between the specularly arranged semi-panels.
Figure 3:
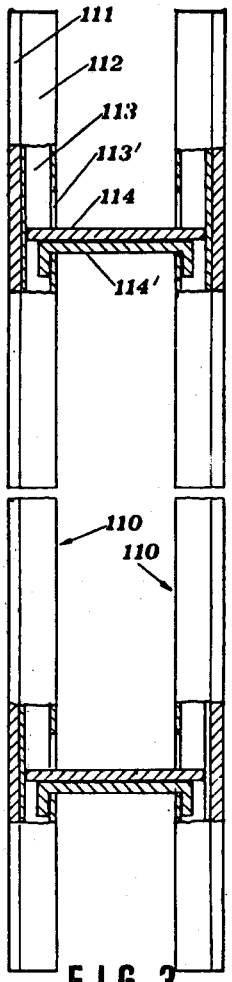
FIG. 3 is a schematic side view of a pair of semi-panels which form a wall, the shape of the semi-panels and the respective connecting spacers being evidenced by partial sections taken along line 3—3 of FIG. 4.
Figure 4:
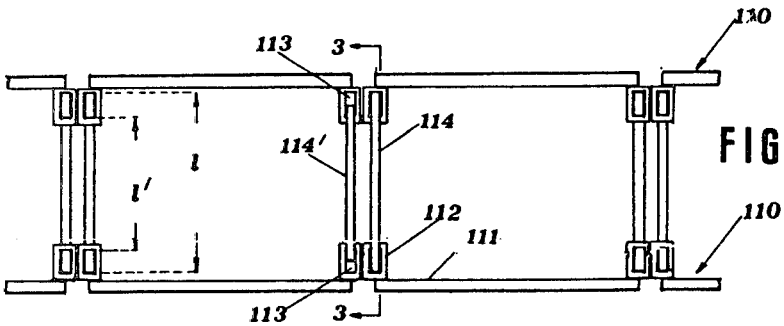
FIG. 4 is a schematic view of the wall formed by assembling semi-panels and spacers as in FIGS. 2 and 3.

FIG. 2 is a schematic elevation view of one of the two faces of a wall assembled by using semi-panels 110, a portion of which has been removed in order to show openings 113' as provided along the free inner side of rectangular protusions 112 of the semi-panels, as well as the pair of connecting spacers 114, 114' in a cross-section thereof, these spacers being laid one upon the other and inserted in the openings 113' as stated above and better illustrated in FIG. 3. It is then possible to better understand the actual functions of the connecting spacers 114, 114'.

Further reference to the embodiment of semi-panels 110, FIG. 2 evidences that auxiliary connecting means 116 may also be provided between tubular protusions 112 of semi-panels 110 or between these latter and respective tubular elements 115 which rise from the foundations or those respective building parts (not shown) above the structure of FIG. 2.

In embodiments wherein semi-panels 10, 110 are provided which have a U shape, as illustrated in FIGS. 1 to 5, the characteristic protrusions 12–12' and 112, respectively, are disposed at the opposite ends of a corresponding plane body 11, 111 which substantially forms a component part of one face of the wall to be built. That is to say, this face with a finished structure when the plane bodies 11, 111 of component semi-panels 10 or 110 will be arrranged side-to-side and secured to each other along its junction vertical lines by using a proper binding means according to the material of the semi-panels, so that a single vertical plane is obtained.

A different embodiment is schematically illustrated in FIG. 6, wherein a semi-panel 210 has a T and not a U shape, the medial protrusion 212 of which is provided with a spacing 213 in which are seated the respective edges of a set of connecting spacers in its spaced arrangement as provided in preceding embodiments, or the respective edge of a single connecting spacer 214 as preferably provided in this embodiment. It is evident in this case that the plane bodies 211 of component semi-panels 210 will be arranged side-to-side and bound along its opposite and tallying edges 211' to form the desired vertical plane of the respective wall face.

Figure 7:
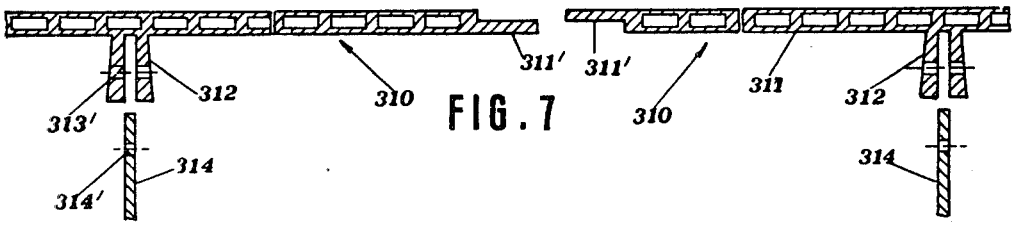
FIG. 7 is a schematic horizontal section of semi-panels according to a further embodiment of the present invention.

It is also possible to provide semi-panels, the plane bodies of which have step-like edges. According to the embodiment schematically illustrated in FIG. 7, plane bodies 311 of semi-panels 310 are provided, the adjacent step-like edges of which are opposite each other in order that they may be placed one upon the other to be connected and bound so that a wall may be obtained with a plane outer face. Also, it can be seen in FIG. 7 that the plane bodies 311 of semi-panels are of a perforated type, to be considered useful by those skilled in the art, to satisty a particular necessity and/or utility of application and construction.

In another embodiment using semi-panels and connecting spacers according to the principles of the invention, two semi-panels 410 are schematically illustrated in FIG. 8 with respective connecting spacers 414. The plane body 411 of semi-panel 410 is a full body having its two opposite ends bent at 90°, so that two protusions are provided as usual, which will be inside specularly opposite when a wall is to be assembled. According to this embodiment, connecting spacers 414 are provided with U shaped opposite ends, so that the respective bent ends 412 of semi-panels 410 may be seated in spacing 414'' of ends 414' of the spacers. In this manner a suitable connection may be performed between protusions 412 and spacer ends 414' by means of bolts, rivets or the like, or by using a binding material suitable for the material of semi-panels and spacers.

As mentioned early in this description, the semi-panels according to the present invention may also be used for other applications in addition to the more usual applications to build walls and/or ceilings. This further possibility is, for example, evidenced by the embodiment illustrated in FIG. 9, wherein two semi-panels 511 which are connected to each other by means of spacers 514, in a manner described hereinabove are spaced apart from each other and, in turn, connected to two other auxiliary elements 515, so that the perimetral part of a guadrangular pillar form may be provided. The inner hollow c of this pillar form may then be filled with concrete. Some reinforcing iron rods t may also be included, if desired, in order to provide a reinforced-concrete pillar.

While some embodiments have been described and illustrated it should be pointed out that they have no limitative purpose, and other modifications and/or changes are also possible when considered by those skilled in the art as appropriate and useful for different constructions.

Modifications and/or changes are in any case to be considered from now on as claimed when based on the underlying principles of the present invention.

What is claimed is:

1. A construction member for building inner and/or bearing walls and the like, comprising at least a pair of semi-panels arranged spaced apart in opposed specular relation, said panels comprising plane bodies forming faces of a building structure, integral U-shaped pairs of connecting elements protruding from said bodies having opposed outer ends spaced a predetermined distance apart, said parts of elements lying perpendicular to said bodies and defining recesses therebetween, walls spaced from inner sides of said panels and interconnecting said outer ends of said pairs of connecting elements, said walls having opposed spaced openings, pairs of spacers extending between said bodies and into said opposed openings, opposite ends of one of said pairs of spacers solely defining the spacing between said panels while abutting against said inner sides of said panels, the other of said pairs of said spacers having opposite ends bent and engaged with inner surfaces of said interconnecting walls for solely interconnecting said panels, whereby the construction member withstands tensive and compressive stresses acting against opposite sides of said panels.

* * * * *